US010661943B2

(12) United States Patent
Gatewood et al.

(10) Patent No.: US 10,661,943 B2
(45) **Date of Patent: *May 26, 2020**

(54) METAL END CLOSURE WITH AN EXTENDED SCORE WHICH IS OPENED WITH A SECONDARY TOOL

(71) Applicant: Ball Corporation, Broomfield, CO (US)

(72) Inventors: Erik E. Gatewood, Arvada, CO (US); Mark A. Jacober, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 16 days.

This patent is subject to a terminal disclaimer.

(21) Appl. No.: 15/979,153

(22) Filed: May 14, 2018

(65) Prior Publication Data

US 2018/0257812 A1 Sep. 13, 2018

Related U.S. Application Data

(63) Continuation of application No. 14/829,887, filed on Aug. 19, 2015, now Pat. No. 9,969,524.

(60) Provisional application No. 62/039,020, filed on Aug. 19, 2014.

(51) Int. Cl.
*B65D 17/40* (2006.01)
*B65D 17/28* (2006.01)

(52) U.S. Cl.
CPC ..... *B65D 17/40* (2018.01); *B65D 17/4012* (2018.01); *B65D 2517/002* (2013.01); *B65D 2517/007* (2013.01); *B65D 2517/0014* (2013.01)

(58) Field of Classification Search
CPC ..... B65D 17/165; B65D 2517/0094; B65D 2517/0014; B65D 2517/0013; B65D 2517/002
See application file for complete search history.

(56) References Cited

U.S. PATENT DOCUMENTS

| | | | |
|---|---|---|---|
| 4,148,410 | A | 4/1979 | Brown |
| 4,205,760 | A | 6/1980 | Hasegawa |
| 4,210,257 | A | 7/1980 | Radtke |
| 4,361,251 | A | 11/1982 | Langseder et al. |
| 4,416,389 | A | 11/1983 | Wilkinson et al. |

(Continued)

FOREIGN PATENT DOCUMENTS

WO WO 2015/138413 9/2015

OTHER PUBLICATIONS

International Search Report and Written Opinion for International (PCT) Patent Application No. PCT/US15/45839, dated Nov. 12, 2015, 12 pages.

(Continued)

*Primary Examiner* — Shawn M Braden
(74) *Attorney, Agent, or Firm* — Sheridan Ross P.C.

(57) ABSTRACT

A metallic container end closure is provided that generally comprises a primary pour opening and an extended or secondary score which is opened with a secondary tool to form a secondary pour opening. The fact that a secondary tool is required allows the secondary score to be shallower, and thus more secure than deeper scores that are openable by finger pressure alone. Once the secondary tool is used to fracture the secondary score, a secondary pour opening is produced adjacent to the primary pour opening to form a larger opening. A user may insert materials such as ice or oranges through the enlarged pour opening.

20 Claims, 4 Drawing Sheets

(56) References Cited

U.S. PATENT DOCUMENTS

| | | | |
|---|---|---|---|
| 4,465,204 | A | 8/1984 | Kaminski et al. |
| 5,007,554 | A | 4/1991 | Hannon et al. |
| 5,307,947 | A | 5/1994 | Moen et al. |
| 5,397,014 | A | 3/1995 | Aydt |
| 5,555,992 | A | 9/1996 | Sedgeley |
| 6,024,239 | A | 2/2000 | Turner et al. |
| 6,079,583 | A | 6/2000 | Chasteen |
| 6,354,453 | B1 | 3/2002 | Chasteen |
| 6,761,281 | B2 | 7/2004 | Hartman |
| 7,096,759 | B2 | 8/2006 | Kirko |
| D559,680 | S | 1/2008 | Jacober et al. |
| 7,513,383 | B2 | 4/2009 | Hwang |
| 7,748,557 | B2 | 7/2010 | Robinson |
| 7,975,884 | B2 | 7/2011 | Mathabel et al. |
| 8,245,866 | B2 | 8/2012 | Gibson et al. |
| D691,039 | S | 10/2013 | Jacober et al. |
| 8,567,158 | B2 | 10/2013 | Chasteen et al. |
| 8,678,221 | B2 | 3/2014 | Thiemann et al. |
| D715,144 | S | 10/2014 | Scott |
| D715,647 | S | 10/2014 | Jacober et al. |
| 8,893,913 | B2 | 11/2014 | McClung et al. |
| 8,939,306 | B2 | 1/2015 | Rios |
| 8,939,308 | B2 | 1/2015 | Ramsey et al. |
| 9,016,504 | B2 | 4/2015 | McClung et al. |
| D731,887 | S | 6/2015 | Keane et al. |
| 9,102,451 | B2 | 8/2015 | McClung et al. |
| 9,139,343 | B2 | 9/2015 | Neiner |
| 9,156,585 | B2 | 10/2015 | Neiner |
| 9,162,795 | B2 | 10/2015 | Thiemann et al. |
| 9,181,006 | B2 | 11/2015 | Neiner et al. |
| 9,181,007 | B2 | 11/2015 | Forrest et al. |
| 9,186,924 | B2 | 11/2015 | Lewis |
| 9,233,784 | B2 | 1/2016 | Jacober et al. |
| 9,403,628 | B2 | 8/2016 | Keane et al. |
| 9,561,888 | B2 | 2/2017 | Nesling et al. |
| 9,969,524 | B2 | 5/2018 | Gatewood et al. |
| 2002/0139800 | A1 | 10/2002 | Hwang et al. |
| 2010/0294771 | A1 | 11/2010 | Holder |
| 2011/0056946 | A1 | 3/2011 | Emanuele et al. |
| 2012/0048870 | A1 | 3/2012 | Ellerbe, III et al. |
| 2013/0118133 | A1 | 5/2013 | Jacober et al. |
| 2014/0096491 | A1 | 4/2014 | Chasteen et al. |
| 2014/0103044 | A1 | 4/2014 | Ramsey et al. |
| 2014/0110408 | A1 | 4/2014 | Mitchell et al. |
| 2014/0263327 | A1 | 9/2014 | Chasteen et al. |
| 2014/0263329 | A1 | 9/2014 | Chasteen et al. |
| 2014/0263334 | A1 | 9/2014 | Scott |
| 2015/0001220 | A1 | 1/2015 | Neiner |
| 2015/0136776 | A1 | 5/2015 | Chasteen et al. |
| 2015/0158627 | A1 | 6/2015 | Ramsey et al. |
| 2015/0196948 | A1 | 7/2015 | McClung et al. |
| 2015/0239607 | A1 | 8/2015 | Fields et al. |
| 2015/0251803 | A1 | 9/2015 | Rayburn |
| 2015/0329238 | A1 | 11/2015 | Chasteen et al. |
| 2015/0367984 | A1 | 12/2015 | Forrest et al. |
| 2016/0023801 | A1 | 1/2016 | Keane |
| 2016/0031613 | A1 | 2/2016 | Chasteen et al. |
| 2016/0039563 | A1 | 2/2016 | Dunwoody et al. |
| 2017/0107010 | A1 | 4/2017 | Keane et al. |
| 2018/0244445 | A1 | 8/2018 | Neiner |
| 2018/0362209 | A1 | 12/2018 | Ramsey et al. |

OTHER PUBLICATIONS

International Preliminary Report on Patentability for International (PCT) Patent Application No. PCT/US2015/045839, dated Mar. 2, 2017 12 pages.

Official Action for Canada Patent Application No. 2,958,649, dated Dec. 15, 2017 3 pages.

Notice of Allowance for Canada Patent Application No. 2,958,649, dated Jul. 27, 2018 1 page.

Extended Search Report for European Patent Application No. 15833338.5, dated Feb. 22, 2018 9 pages.

Official Action for U.S. Appl. No. 14/829,887, dated Feb. 6, 2017 6 pages Restriction Requirement.

Official Action for U.S. Appl. No. 14/829,887, ddted Apr. 27, 2017 14 pages.

Official Action for U.S. Appl. No. 14/829,887, dated Sep. 28, 2017 6 pages.

Notice of Allowance for U.S. Appl. No. 14/829,887, dated Feb. 1, 2018 7 pages.

METAL END CLOSURE WITH AN EXTENDED SCORE WHICH IS OPENED WITH A SECONDARY TOOL

CROSS-REFERENCE TO RELATED APPLICATIONS

This application is a continuation of U.S. patent application Ser. No. 14/829,887 filed Aug. 19, 2015, which claims priority under 35 U.S.C. § 119(e) to U.S. Provisional Patent Application Ser. No. 62/039,020 filed Aug. 19, 2014, each of which is incorporated by reference herein in their entirety.

FIELD OF THE INVENTION

The present invention relates generally to a metallic container end closure, and more particularly, to a metallic container end closure with a secondary pour opening that is opened with a secondary tool to provide enhanced flow and pourability characteristics.

BACKGROUND OF THE INVENTION

Generally, the configuration of a container end closure affects the level to which end consumers, as well as bottlers, manufacturers, distributors, shippers, and retailers, are satisfied with a container. One factor of importance to consumers is the pour characteristics of the container. In general, consumers prefer containers that provide a smooth or substantially laminar pour, i.e., a pour which is not characterized by a series of surges or "glugging".

Many container configurations exist to enhance flow through a pour opening. For example, some containers utilize a single, large pour opening to admit air for venting the dispensed liquid. Examples are provided in U.S. Pat. Nos. 4,210,257; 5,007,554; 4,416,389; 4,148,410; 4,465,204; and 4,361,251; the disclosures of which are incorporated herein by reference in their entirety. However, single, uniform pour openings are prone to the surging or "glugging" issues described above. Further, overly large pour openings may be difficult to open with a traditional stay on pull tab ("SOT") due to the extended length of the score line and tear panel, thus causing consumer frustration.

In order to alleviate the surging or "glugging" issue, some containers utilize a second vent hole to depressurize a container, and thus allow for easier opening of the pour opening and for smoother and more laminar pours. Examples are provided in U.S. Pat. Nos. 4,205,760; 5,307,947; 5,397,014; 6,024,239; 6,079,583; 7,513,383; 7,748,557; 8,245,866 and U.S. Patent Application Publication Nos. 2010/0294771, 2011/0056946 and 2002/0139800; the disclosures of which are incorporated herein by reference in their entirety. While these configurations improve the pour characteristics of the container, the fact that the second vent hole is separate from the pour opening limits the placement and size of the second vent hole and the pour opening.

Another factor of importance to consumers is the functionality of the container for adding items to the container. Due to a renaissance in the craft beer market, consumers are adding materials to their drinks such as oranges, limes, and other drinks such as vegetable juice, hot sauce, etc. Consumers may also want to simply add materials such as ice. Because secondary vent hole configurations limit the size of both the second vent hole and the pour opening, the consumer is prohibited from adding these materials to his or her drink.

Another configuration of end closure utilizes additional opening areas that are adjacent to the pour opening. For example, an end closure with a second and third opening area is described in U.S. Pat. No. 8,567,158, the disclosure of which is incorporated herein by reference in its entirety. These additional opening areas are opened by pivoting a pull tab over an additional opening and applying a downward force to the additional opening. Because these additional opening areas are opened by finger pressure alone, the scores for the secondary vent tear panels are generally deeper, i.e., less score residual, and thus prone to premature severing which causes failure, leaks, and economic loss during stacking or transportation. In addition, the size of the additional openings is limited, again, because only finger pressure is used and proximity to the pull tab is required. Therefore, the additional openings may not be sufficiently large enough to accommodate additional materials such as ice, limes, and oranges.

Thus, there is a need to provide a container end closure that provides enhanced pour characteristics with an enlarged primary pour opening and adjacent secondary vent opening which further allows the insertion of additional materials such as fruit or juice while minimizing the likelihood of problems such as bursting, buckling, leakage, opening failures, and the like.

SUMMARY OF THE INVENTION

The above needs and other needs are addressed by the various embodiments and configurations of the present invention. This invention relates to a novel container end closure that utilizes a secondary tool to fracture an extended or secondary score to displace a secondary tear panel and create a secondary pour opening. While some embodiments of the present invention are described as metal or metallic, it will be appreciated that aspects of the present invention may be applied to other container materials such as plastic, glass, tin-coated steel alloys, and containers and end closures with coatings such as epoxy resin.

It is an aspect of the present invention to provide an end closure with a secondary score and secondary tear panel that enlarges a primary pour opening of the end closure. Embodiments of the present invention include the secondary tear panel to not only provide enhanced pourability but to also allow a consumer to insert materials in the container such as ice, fruit wedges, or liquids such as juice. Therefore, the secondary tear panel may be located adjacent to a primary tear panel to enlarge the primary pour opening.

It is another aspect of the present invention to provide an end closure with a secondary score and secondary tear panel that may require a secondary tool to fracture the secondary score. As a result, the secondary score may be shallow whereas ordinary finger pressure alone will not be sufficient to fracture the secondary score. A secondary tool provides additional leverage to fracture the secondary score and open the secondary tear panel. A secondary tool may be any object that is not a pull tab such as coins, bottle openers, i.e., church keys, car keys, screw drivers, etc. Embodiments of the present invention may also include a depression(s) or protrusion(s) located proximate to the secondary score such that a user may locate the secondary tool in the depression or adjacent to the protrusion to generate leverage against the secondary score.

It is another aspect of the present invention to provide an end closure with a secondary score and secondary tear panel wherein the transition between a deboss area and non-deboss area of a central panel provides a location for the secondary tear panel to pivot about. The secondary tear panel may be at least partially defined by a primary score, a secondary score, and the transition between the deboss area and non-deboss area of a central panel. Thus, when a user fractures the primary and secondary scores, the user may pivot the secondary tear panel about the transition to enlarge the pour opening of the end closure. However, it will be appreciated that the secondary tear panel may pivot about other locations such as a hinge positioned on one of the deboss area or the non-deboss area.

It is a further aspect of the present invention to position one or more tear panels relative to an area of engagement defined by a pull tab. The pull tab may rotate about a rivet in various embodiments, and the pull tab has a nose that drives downward against a central panel to rupture a score. Thus, there is an area of engagement defined by the nose of the pull tab rotating about the rivet where the nose may engage the central panel. In some embodiments, a primary tear panel may be at least partially disposed in this area of engagement such that the nose of the pull tab may engage the primary tear panel and generate a downward force that ruptures a primary score, which defines the primary tear panel. A secondary tear panel may be positioned outside of the area of engagement such that the nose of the pull tab does not engage any portion of the secondary tear panel. A secondary score that may at least partially define the secondary tear panel can therefore have a shallower score, i.e., a larger score residual of material left remaining after the score has been stamped or cut into the central panel. Thus, a user may utilize a secondary tool to generate a larger downward force than provided with a pull tab to rupture the secondary score. It will be appreciated that in some embodiments, a portion of the secondary tear panel may be disposed within the area of engagement by the nose of the pull tab.

It is another aspect of the present invention to provide an end closure with a secondary score and secondary tear panel where the end closure comprises another secondary score and another secondary tear panel. For example, the primary tear panel may be flanked by a secondary score on each side of the primary tear panel wherein each secondary score partially defines a tear panel. It will also be appreciated that the multiple tear panels may vary in size. In one embodiment, the primary tear panel is flanked on either side by a secondary score, but one secondary score is longer than the other. Thus, one secondary tear panel is larger than the other. A consumer may find the variable secondary tear panel size useful for inserting different materials into the container. For example, ice may require a larger or smaller secondary tear panel size than fruits such as oranges.

It is an aspect of the present invention to provide an end closure with a secondary score and secondary tear panel wherein the secondary score forms a variety of shapes. In one embodiment, the secondary score extends outward from the primary score and a transition zone in an arc. The arc may curl toward the front or rear side of the central panel in various embodiments. Further, the arc may comprise various radii of curvature. It will be appreciated that a variety of shapes may be used including, but not limited to, straight lines, polygons, n-order polynomials, and splines. Further, the secondary score need not be a continuous score. For example, the secondary score may have a variable depth or residual and may comprise additional transition zones.

Another aspect of the present invention is to provide an end closure with a secondary score and secondary tear panel where the area of the secondary tear panel and primary tear panel may be expressed in terms of percentage of the central panel surface area. In one embodiment, the combined area of the secondary tear panel and primary tear panel is between approximately 25% and 50% of the area of the central panel. In some embodiments, the combined area of the secondary tear panel and the primary tear panel is between approximately 10% and 33% of the area of the central panel. In other embodiments, the combined area of the secondary tear panel and primary tear panel is between approximately 35% and 40%. It will be appreciated that different ways may be used to characterize the size of the secondary tear panel, the primary tear panel, and the central panel relative to one another, as discussed elsewhere herein.

A specific embodiment of the present invention is a container end closure with a peripheral curl adapted for interconnection to a neck of a container, comprising a central panel having a rivet interconnecting a pull tab to an upper surface of the central panel, the pull tab adapted for applying a downward force; a primary tear panel disposed on the central panel, the primary tear panel at least partially defined by a primary score, the primary score configured to by sheared by the downward force of the pull tab to deflect the primary tear panel and create a primary pour opening; and a secondary tear panel disposed on the central panel, the secondary tear panel at least partially defined by a secondary score proximate to said primary score, the secondary tear panel configured to be sheared by a downward force generated by a secondary tool to deflect the secondary tear panel and create a secondary pour opening, wherein the primary pour opening and the secondary pour opening are positioned adjacent to form a contiguous pour opening area to enhance pour characteristics and selectively allow insertion of additional materials.

In some embodiments of the present invention, a nose of the pull tab is rotatable about the rivet to define an area of engagement about the rivet, wherein at least a portion of the primary tear panel is positioned in the area of engagement, and the secondary tear panel is positioned outside of the area of engagement. Further, the secondary tear panel may be at least partially defined by the primary score and a transition portion between a deboss area of the central panel and a non-deboss area of the central panel, and the secondary tear panel is deflectable about the transition portion.

In various embodiments, the secondary score forms an arc having a predetermined radius, and in some embodiments, the radius of the arc is between approximately 0.01 and 1.0 inches. In certain embodiments, the contiguous pour area covers between approximately 10% and 33% of an area of the central panel. In various embodiments, the end closure comprises at least two secondary pour openings positioned proximate to the primary pour opening.

In further embodiments, a transition zone is positioned between one end of the primary score and one end of the secondary score, wherein the transition zone is one of an uninterrupted portion of the central panel and a check slot having a score residual that is distinct from a score residual of the primary score. In some embodiments, a protrusion or a depression is positioned proximate to the secondary score, the protrusion or the depression configured to receive a portion of the secondary tool to provide the downward force on the secondary tear panel.

A further embodiment of the present invention is a method of forming a primary pour opening and an adjacent secondary pour opening in a metallic end closure to enhance pour characteristics, comprising (a) providing the metallic end closure adapted for interconnection to a neck of a container, comprising: (1) a central panel with a peripheral curl on a perimeter edge, a pull tab for applying a first downward force on a primary tear panel interconnected to the central panel, and the primary tear panel at least partially defined by a primary score; (2) a secondary tear panel positioned adjacent to the primary tear panel, the secondary tear panel at least partially defined by a secondary score; (b) lifting a tail end of the pull tab to apply the first downward force on the primary tear panel to shear the primary score, deflect the primary tear panel, and create the primary pour opening in the metallic end closure; (c) providing a secondary tool for applying a second downward force on the secondary tear panel; and (d) engaging the secondary tool with the secondary tear panel to apply the second downward force on the secondary tear panel to shear the secondary score, deflect the secondary tear panel, and create the secondary pour opening in the metallic end closure.

In some embodiments of the present invention, the method further comprises rotating a nose of the pull tab about the rivet to define an area of engagement about the rivet, wherein at least a portion of the primary tear panel is positioned in the area of engagement, and the secondary tear panel is positioned outside of the area of engagement. In further embodiments, the secondary tear panel is at least partially defined by the primary score and a transition portion between a deboss area of the central panel and a non-deboss area of the central panel, and when the secondary tool engages the secondary tear panel to shear the secondary score, the secondary tear panel may be deflected about the transition portion.

In certain embodiments, the secondary score is at least partially defined by an arc having a predetermined radius, and the radius of the arc may be between approximately 0.01 and 1.0 inches. In various embodiments, the method further comprises providing a transition zone positioned between one end of the primary score and one end of the secondary score, wherein when the secondary tool engages the secondary tear panel, the second downward force shears the transition zone, and the transition zone may be one of an uninterrupted portion of the central panel and a check slot having a score residual that is distinct from a score residual of the primary score.

Yet another specific embodiment of the present invention is a container end closure with a peripheral curl adapted for interconnection to a neck of a container, comprising a central panel having a rivet interconnecting a pull tab to an upper surface of the central panel, the pull tab adapted for applying a downward force, wherein a nose of the pull tab is rotatable about the rivet to define an area of engagement about the rivet; a primary tear panel disposed on the central panel, the primary tear panel at least partially defined by a primary score, wherein at least a portion of the primary tear panel is positioned in the area of engagement, the primary score configured to by sheared by the downward force of the pull tab to deflect the primary tear panel and create a primary pour opening; a secondary tear panel disposed on the central panel, the secondary tear panel at least partially defined by a secondary score, the primary score, and a transition portion between a deboss area of the central panel and a non-deboss area of the central panel, wherein the secondary tear panel is positioned outside of the area of engagement, the secondary tear panel configured to be sheared by a downward force generated by a secondary tool to deflect the secondary tear panel about the transition portion and create a secondary pour opening; a transition zone positioned between one end of the primary score and one end of the secondary score, wherein the transition zone is one of an uninterrupted portion of the central panel and a check slot having a score residual that is distinct from a score residual of the primary score; and wherein the primary pour opening and the secondary pour opening combine to form a contiguous pour opening area to enhance pour characteristics and selectively allow insertion of additional materials into the container.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements or components. Additional aspects of the present invention will become more readily apparent from the Detailed Description, particularly when taken together with the drawings.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Figure 1:
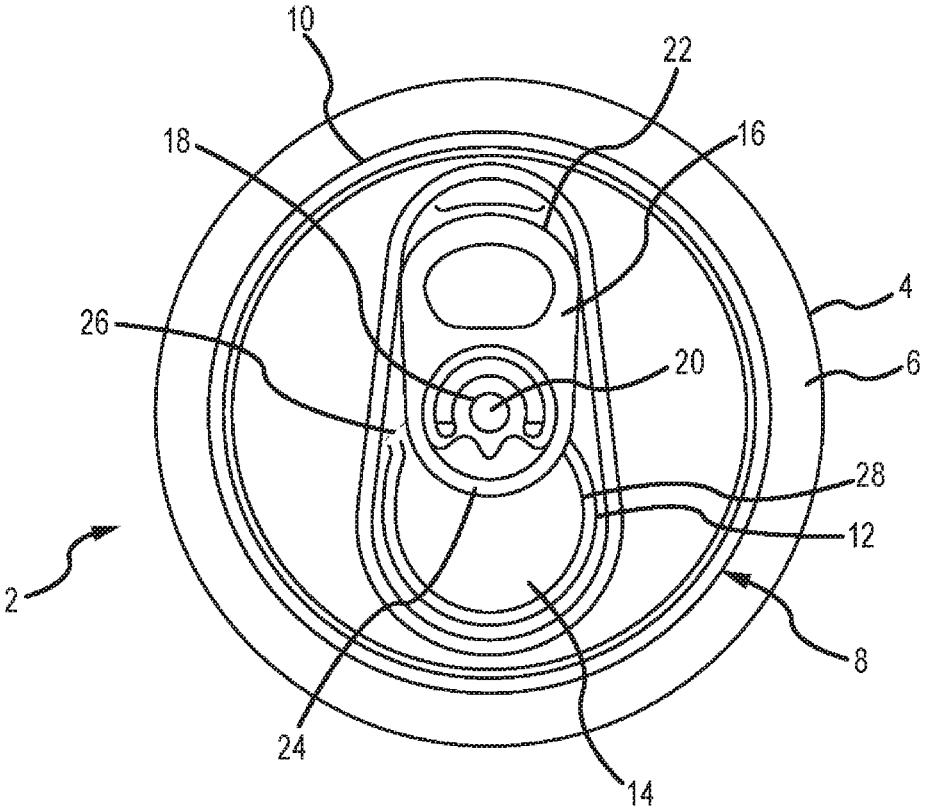
FIG. 1 PRIOR ART
FIG. 1 is a top plan view of a prior art and closure interconnect to a container with a single pour opening.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 2 | Container |
| 4 | Container Body |
| 6 | Necked Region |
| 8 | End Closure |
| 10 | End Closure Outer Perimeter |
| 12 | Primary Score |
| 14 | Primary Tear Panel |
| 16 | Pull Tab |
| 18 | Rivet |
| 20 | Pivot Point |
| 22 | Tail |
| 24 | Nose |
| 26 | Hinge |
| 28 | Anti-Fracture Score |
| 30 | Central Panel |
| 32 | Deboss |
| 34 | Secondary Score |
| 36 | Area of Engagement |
| 38 | Transition Zone |
| 40 | Secondary Tear Panel |
| 42 | Protrusion |
| 44 | Depression |
| 46 | Primary Pour Opening |
| 48 | Secondary Pour Opening |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present invention are described herein and as depicted in the drawings. It is expressly understood that although the figures depict metal end closures, container bodies, secondary scores, and methods and systems for using the same, the present invention is not limited to these embodiments. It should also be understood that the terms "container" and "container body", "end closure" and "container end closure", and "extended score" and "secondary score", "tear panel" and "portion", and "main" and "primary" may be used interchangeably in some instances.

Referring to FIG. 1, a top plan view of a prior art container with a single pour opening is shown. In the container 2 of FIG. 1, a container body 4 is provided with a necked region 6 leading to a body end which is covered, in the depicted embodiment, with an end closure 8. Manners of forming container bodies 4 and end closures 8 and of attaching or coupling the two, to form the depicted device, are well known in the art.

The end closure 8 generally has an end closure outer perimeter 10 and includes a primary score 12 commonly formed by stamping with a die or "knife" to define a primary tear panel 14. A pull tab 16 is coupled to the end closure 8, for example, by a rivet 18 whose center defines a pivot point 20. Generally, lifting the tail 22 of the pull tab 16 upward results in the nose 24 of the pull tab 16 pressing downward on part of the primary tear panel 14 with sufficient force to cause a rupture to form along the primary score 12, causing the primary tear panel 14 to bend or pivot inward about a hinge 26 defined between the end points of the primary score 12. Once the primary tear panel 14 has been deflected inward, the end closure 8 has a primary pour opening with a perimeter defined by the primary score 12 and the hinge 26.

In the depicted configuration, a second inward "anti-fracture" score 28 is positioned substantially parallel with the primary score 12 and may form a loop with the primary score 12 underneath the nose 24 of the pull tab 16. Typically, the anti-fracture score 28 has a shallower depth than the primary score 12. In other words, the anti-fracture score 28 has a larger score residual, or larger amount of material underneath the score, than the primary score 12. The anti-fracture score 28 is located proximate to the primary score 12 to relieve stress areas around the anti-fracture score 28 and prevent accidental opening of the primary score 12.

Figure 2:
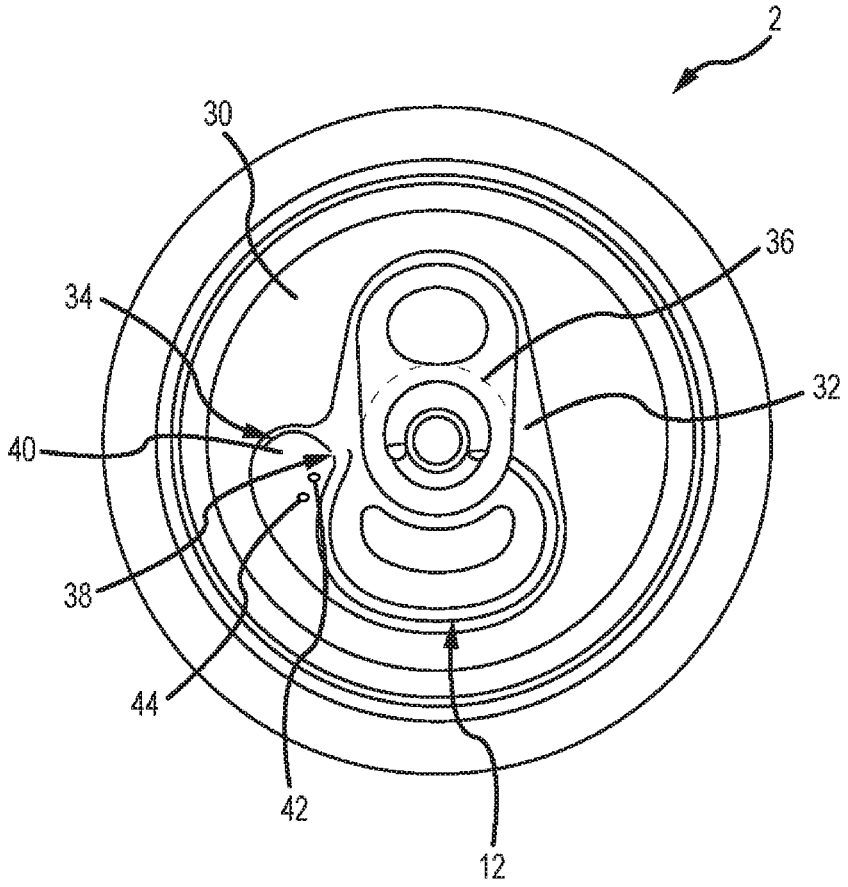
FIG. 2 is a top plan view of an end closure interconnected to a neck of a container with a secondary score, wherein the primary and secondary pour openings are in a closed position.

Now referring to FIG. 2 and one embodiment of the present invention, a top plan view of an end closure 8 with a secondary score 34 is provided. The end closure 8 comprises a central panel 30 on which various features of the end closure 8 are disposed. A deboss area 32 is a recessed portion of the central panel 30. Features such as the rivet 18 and the pull tab 16 may be disposed on the deboss portion 32 of the central panel 30 so that the pull tab 16 is less susceptible to accidental openings and to improve the stackability of multiple end closures 8.

As shown in FIG. 2, the primary score 12 is disposed on the deboss portion 32 of the central panel 12. The primary score 12 begins underneath the nose 24 of the pull tab 16 and extends to form a primary tear panel 14. As mentioned above, an anti-fracture score 28 is positioned on the primary tear panel 14 and follows the primary score 12. The primary score 12 and the anti-fracture score 28 terminate at a location proximate the rivet 18 and the beginning of the primary score 12 underneath the nose 24 of the pull tab 16. This area under the pull tab 16 may be referred to as an area of engagement 36, which his described in further detail below. As mentioned above, this unscored portion of the central panel 30 forms a hinge 26 about which the primary tear panel 14 may pivot.

Adjacent to an end of the primary score 12 is a transition zone 38 which may be an unscored portion of the central panel 30 between the primary score 12 and a secondary score 34. The transition zone 38 contributes to the necessity of a secondary tool to fracture the secondary score 34 and helps prevent accidental opening of the secondary score 34, leaks, deformations, etc. Some embodiments of the present invention may optionally include a transition zone 38, and the secondary score 34 may be continuous with the end of the primary score 12. Further, the transition zone 38 may be a check slot in some embodiments or any other feature that inhibits propagation of a fracture along the primary score 12.

The secondary score 34 extends outward from the transition zone 38 toward an edge of the central panel 30, where a first end of the secondary score 34 is positioned proximate to the transition zone 38 and a second end of the secondary score 34 is positioned opposite the first end. The shape of the secondary score 34 in FIG. 2 is an arc with a radius of curvature. In some embodiments, the radius of curvature is between approximately 1 and 0.01 inches. In other embodiments, the radius of curvature is between approximately 0.2 and 0.08 inches. In yet another embodiment, the radius of curvature is approximately 0.14 inches. It will be appreciated that a variety of secondary score 34 shapes beyond arcs may be used including, but not limited to, straight lines, polygons, n-order polynomials, spines, etc.

In the embodiment illustrated in FIG. 2, the deboss area 32 of the central panel 30 extends along the secondary score 34 between the secondary score's 34 first end and second end. After the second end, the deboss area 32 continues until it reaches a fixed distance away from the edge of the central panel 30. From this point, the deboss area 32 remains at a fixed distance from the edge of the central panel 30 until the deboss area 32 reaches the primary tear panel 14. The deboss panel 32 then defines an area that captures the primary tear panel 14 and the pull tab 16 before coming full circle back to the secondary score 34.

The transition between the deboss area 32 and the central panel 30 in the area between the secondary score 34 and the forward edge of the primary score 12 serves as a location for a second hinge. When a user applies a secondary tool to a secondary tear panel 40, the user breaks the transition zone 38 and fractures the secondary score 34, which along with the primary score 12 and the transition between the deboss area and the non-deboss area, defines the secondary tear panel 40. A user may then continue to press the secondary tool into the secondary tear panel 40 such that the secondary tear panel 40 pivots about the transition between the deboss area 32 and the central panel 30, or the second hinge. When complete, a secondary pour opening area is created that is adjacent to the primary pour opening, thus forming a larger, combined pour opening.

As shown in FIG. 2, an area of engagement 36 may be defined by the nose of the pull tab 16, and tear panels may be positioned in relation to the area of engagement 36 in some embodiments of the present invention. The pull tab 16 is rotatable about the rivet, and the nose of the pull tab 16 is configured to rupture score lines. Thus, the area of engagement 36 is a circular area on the central panel 30 where the nose of the pull tab 36 may engage the central panel 30 and rupture a score. It will be appreciated that the area of engagement 36 may comprise non-circular shapes since pull tabs 36 do not always rotate completely around a rivet or effectively engage the central panel 30 in some locations between the end of the nose and the center of the pull tab 16.

The primary tear panel and the secondary tear panel 40 may be positioned relative to the area of engagement 36. In some embodiments, at least a portion of the primary tear panel is positioned in the area of engagement 36. Thus, the nose of the pull tab 16 may engage a portion of the primary tear panel to rupture the primary score. In contrast, the secondary tear panel 40 may be positioned outside of the area of engagement 36 such that the nose of the pull tab 16 may not engage the secondary tear panel 40. However, it will be appreciated that in other embodiments, a portion of the secondary tear panel 40 may be positioned in the area of engagement 36. In some of these embodiments, the score residual of the secondary score may be too large for the pull tab 16 to rupture, which necessitates the use of a secondary tool.

Some embodiments of the present invention may include a protrusion 42 or depression 44 to aid the user in fracturing the secondary score 34. As mentioned elsewhere herein, the user may apply a secondary tool to the secondary score 34 to fracture the secondary score 34 and pivot the secondary tear panel 40 about a hinge, thus defining a secondary opening. Some embodiments of the present invention may include a protrusion 42 or depression 44 located proximate to the secondary score 34. In various embodiments, the protrusion 42 and/or depression 44 may be positioned against the deboss area, the non-deboss area, and the transition between the deboss and non-deboss areas. A user may apply one end of a secondary tool in such a depression 44 so that the secondary tool does not slip away as the user engages the secondary score 34. Similarly, the user may apply one end of the secondary tool adjacent to a protrusion 42 so that the secondary tool does not slip away as the user engages the secondary score 34. It will be appreciated that various combinations of protrusions 42 and depressions 44 may be used to aid a user in applying the secondary tool to the end closure 8 of the container 2. This includes embodiments that utilize a plurality of protrusions 42, a plurality of depressions 44, or a combination of both protrusions 42 and depressions 44.

Figure 3:
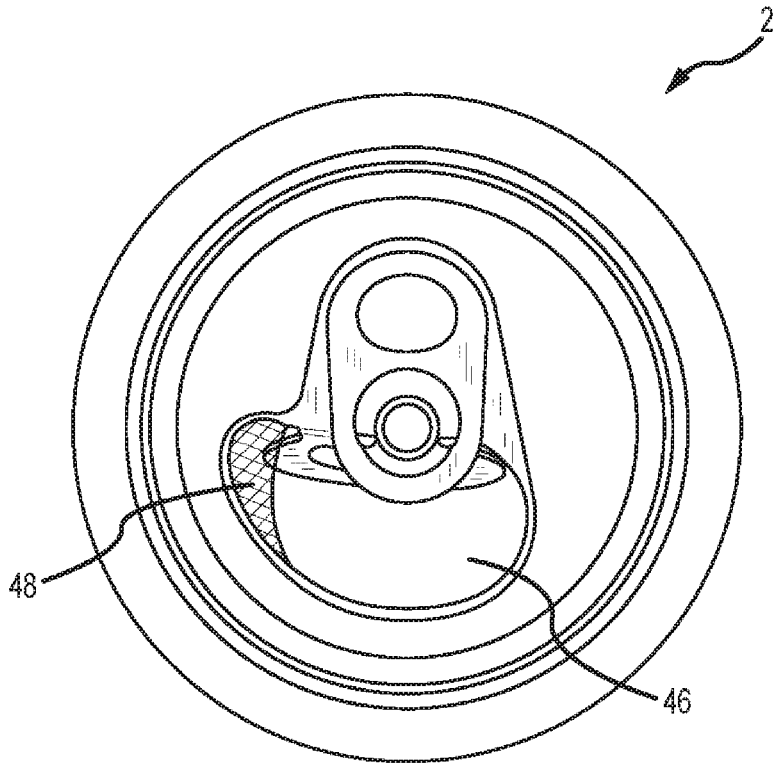
FIG. 3 is a top plan view of the end closure of FIG. 2 wherein the primary pour opening is in an open position and the secondary score has been fractured.

Now referring to FIG. 3, an end closure 8 of a container 2 has a secondary tear panel that has been opened, forming a secondary pour opening 48. The combined area of the secondary pour opening 48 and the primary pour opening 46 may be described as covering a percentage of the area of the central panel. In one embodiment, the combined area of the secondary pour opening 48 and the primary pour opening 46 is between approximately 25% and 50% of the area of the central panel. In some embodiments, the combined area of the secondary pour opening 48 and the primary pour opening 46 is between approximately 10% and 33% of the area of the central panel. In other embodiments, the combined area of the secondary pour opening 48 and the primary pour opening 46 is between approximately 35% and 40% of the area of the central panel. Specifically, the secondary pour opening 48 may have a surface area of between approximately 0.03 square inches to 0.45 square inches. In various embodiments, the secondary pour opening 48 may have a surface area between approximately 0.05 square inches to 0.25 square inches. In some embodiments, the secondary pour opening 48 may have a surface area of approximately 0.15 square inches.

In further embodiments, the end closure 8 of the container 2 comprises a plurality of secondary pour openings 48. In one embodiment, the primary pour opening 46 is flanked on either side by a secondary pour opening 48. In this embodiment, the user may selectively open one or both of the secondary pour openings 48 depending on the requirements of the user. Further, the plurality of secondary pour openings 48 are not necessarily the same size or located symmetrically about the primary pour opening 46. The primary pour opening 46 may be flanked by one secondary pour opening 48 on one side and a larger secondary pour opening 48 on the other side. This configuration provides the user with the ability to open smaller secondary pour opening 48 when adding a smaller material and the ability to open the bigger secondary pour opening 48 or both secondary pour openings 40 when adding larger materials such as fruit, etc.

Further, the secondary pour opening(s) 48 may be located at any point on the central panel 30. In one embodiment, the secondary pour opening 48 comprises the entire central panel 30, and the secondary score 34 extends about a perimeter of the central panel 30. In further embodiments, the secondary pour opening 48 comprises the entire deboss area of the central panel 30, and the secondary score 34 is located proximate to the transition zone between the deboss area and non-deboss area of the central panel 30. Thus, a user may simply remove the deboss area or the central panel 30 entirely.

In addition, and still referring to FIG. 3, the central panel may be divided into quadrants using the pivot point 20. In some embodiments the quadrants may represent co-equal areas of the central panel 30; in other embodiments the quadrants may represent non-equal areas of the central panel 30. In the embodiment depicted in FIG. 3, one reference line can be oriented horizontally through the pivot point 20, and another reference line can be oriented vertically through the pivot point 20. The secondary score 34 has a first and second ends, and in this embodiment, the first end is located on the horizontal reference line between the left forward quadrant and the left rearward quadrant, and the second end is located below the same line in the left forward quadrant.

In other embodiments, the secondary score 34 may be located in other positions relative to the reference lines and quadrants. In various embodiment, the secondary score 34 has both the first end and the second end located on the horizontal reference line between the left forward quadrant and the left rearward quadrant. This includes embodiments with various shapes such that a secondary score 34 may overlap with the horizontal reference line when the secondary score 34 is a straight line. In embodiments where the secondary score 34 is an arc, the secondary score 34 may extend into either the left forward quadrant or the left rearward quadrant. Thus, the top of the secondary score 34 may be above or below the horizontal reference line.

It will be appreciated that the first end and second end of the secondary score 34 as well as the secondary score 34 itself may be located entirely in any one of the left forward quadrant, the left rearward quadrant, the right forward quadrant, and the right rearward quadrant.

Figure 4:
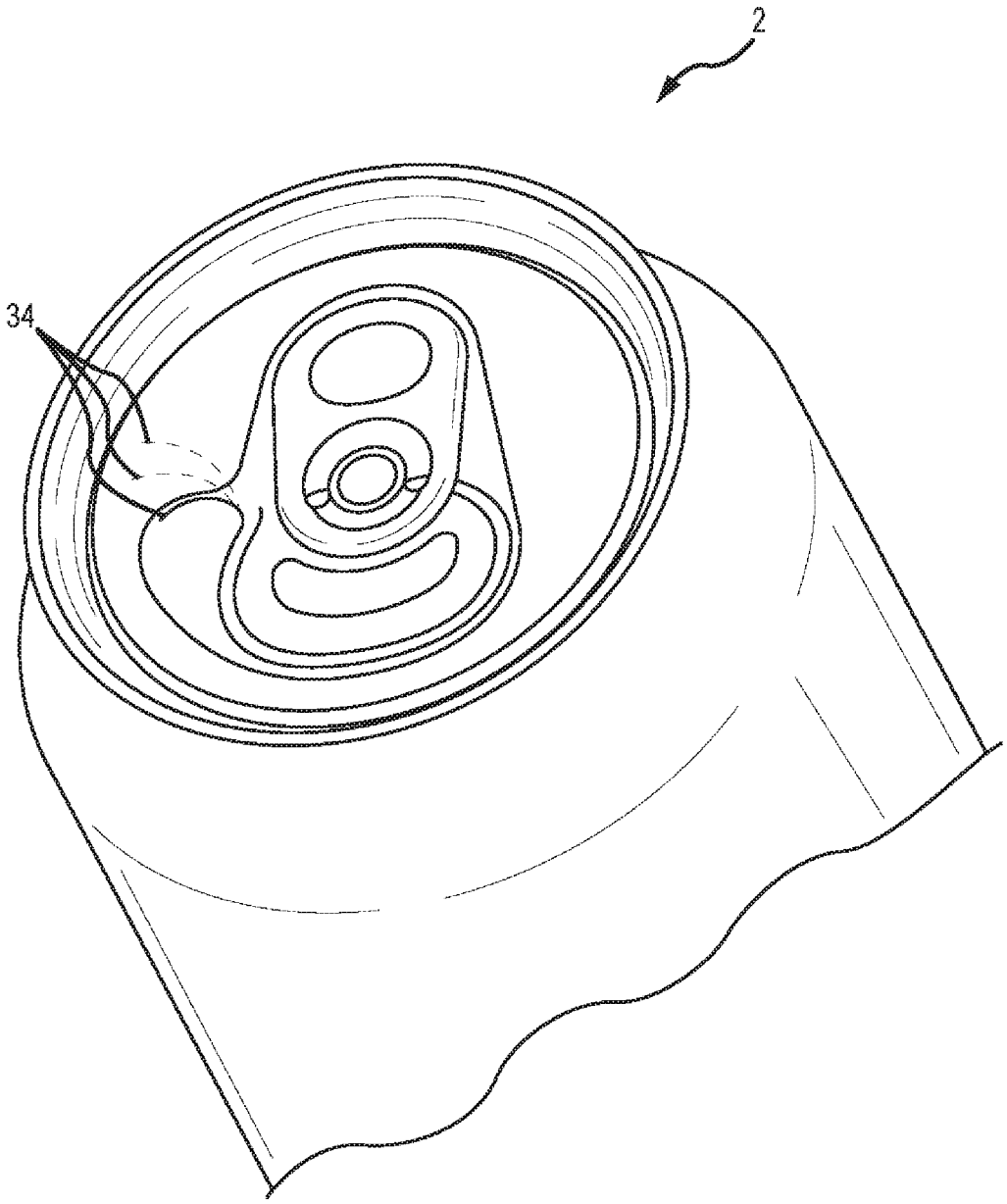
FIG. 4 is top perspective view of one embodiment of an end closure with multiple secondary score positions positioned proximate to the primary pour opening.

Now referring to FIG. 4, an end closure 8 of a container 2 is provided with multiple locations of the secondary score 34. The variable position of the secondary score 34 along with the primary score 12 and the transition between the deboss and non-deboss areas of the central panel 30 provide variable secondary opening sizes.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A container end closure with a peripheral curl adapted for interconnection to a neck of a container, comprising:

a central panel having a rivet interconnecting a pull tab to an upper surface of said central panel, said pull tab adapted for applying a downward force, wherein a nose of said pull tab is rotatable about said rivet to define an area of engagement about said rivet;

a primary tear panel disposed on said central panel, said primary tear panel at least partially defined by a primary score extending from a starting point to a termination point and defined by a first hinge, wherein at least a portion of said primary tear panel is positioned in said area of engagement, said primary score configured to be sheared by said downward force of said pull tab to deflect said primary tear panel about said first hinge and create a primary pour opening; and a secondary tear panel disposed on said central panel, said secondary tear panel at least partially defined by a secondary score extending from a starting point to a termination point and defined by a second hinge, wherein said secondary tear panel is positioned outside of said area of engagement, and said secondary score configured to be sheared by a downward force generated by a secondary tool to deflect said secondary tear panel about said second hinge and create a secondary pour opening, wherein said primary pour opening and said secondary pour opening combine to form a contiguous pour opening area.

2. The container end closure of claim 1, wherein said starting point of said primary score is positioned in said area of engagement, and said termination point of said primary score is positioned outside of said area of engagement.

3. The container end closure of claim 1, wherein said central panel has a transition portion between a deboss area of said central panel and a non-deboss area of said central panel, and wherein at least a portion of said transition portion is said second hinge.

4. The container end closure of claim 1, further comprising a transition zone extending from said termination point of said primary score to said starting point of said secondary score, wherein said transition zone is configured to be sheared by said downward force generated by said secondary tool, and said transition zone is an uninterrupted portion of said central panel.

5. The container end closure of claim 1, wherein said secondary score forms an arc having a predetermined radius between approximately 0.01 and 1.0 inches.

6. The container end closure of claim 1, further comprising a protrusion positioned proximate to said secondary score, said protrusion configured to receive a portion of said secondary tool to provide said downward force on said secondary tear panel.

7. The container end closure of claim 1, further comprising a depression positioned proximate to said secondary score, said depression configured to receive a portion of said secondary tool to provide said downward force on said secondary tear panel.

8. A container end closure with a peripheral curl adapted for interconnection to a neck of a container, comprising:

a central panel having a rivet interconnecting a pull tab to an upper surface of said central panel, said pull tab adapted for applying a downward force, wherein a nose of said pull tab is rotatable about said rivet to define an area of engagement about said rivet;

a primary tear panel disposed on said central panel, said primary tear panel at least partially defined by a primary score extending from a starting point to a termination point, wherein said primary score is configured to be sheared by said downward force of said pull tab to create a primary pour opening;

a secondary tear panel disposed on said central panel, said secondary tear panel at least partially defined by a secondary score extending from a starting point to a termination point, wherein said secondary tear panel is positioned outside of said area of engagement, and said secondary score configured to be sheared by a downward force generated by a secondary tool to create a secondary pour opening; and a transition zone extending from said termination point of said primary score to said starting point of said secondary score, wherein said transition zone is configured to be sheared by said downward force generated by said secondary tool, and said primary pour opening and said secondary pour opening combine to form a contiguous pour opening area to enhance pour characteristics and selectively allow insertion of additional materials into said container.

9. The container end closure of claim 8, wherein said primary tear panel is at least partially defined by a first hinge, and said primary score is configured to be sheared by said downward force of said pull tab to deflect said primary tear panel about said first hinge.

10. The container end closure of claim 8, wherein said secondary tear panel is at least partially defined by a second hinge, and said secondary score is configured to be sheared by said downward force generated by said secondary tool to deflect said secondary tear panel about said second hinge.

11. The container end closure of claim 10, wherein said central panel has a transition portion between a deboss area of said central panel and a non-deboss area of said central panel, and at least a portion of said transition portion is said second hinge.

12. The container end closure of claim 8, wherein said contiguous pour area covers between approximately 10% and 33% of an area of said central panel.

13. The container end closure of claim 8, wherein said central panel has at least two secondary pour openings positioned proximate to said primary pour opening.

14. The container end closure of claim 8, wherein said transition zone is an uninterrupted portion of said central panel.

15. A metallic container end closure, comprising:

a central panel having a rivet interconnecting a pull tab to an upper surface of said central panel, said pull tab adapted for applying a downward force, and said central panel having a transition portion between a deboss area and a non-deboss area of said central panel, wherein a nose of said pull tab is rotatable about said rivet to define an area of engagement about said rivet;

a primary tear panel disposed on said central panel, said primary score configured to be sheared by said downward force of said pull tab to create a primary pour opening; and a secondary tear panel disposed on said central panel, said secondary tear panel at least partially defined by a secondary score and defined by a second hinge, wherein at least a portion of said transition portion is said second hinge, wherein said secondary tear panel is positioned outside of said area of engagement, and said secondary score is configured to be sheared by a downward force generated by a secondary tool to deflect said secondary tear panel about said second hinge and create a secondary pour opening, wherein said primary pour opening and said secondary pour opening combine to form a contiguous pour opening area to enhance pour characteristics.

16. The metallic container end closure of claim 15, wherein said primary tear panel is at least partially defined by a first hinge, and said primary score is configured to be sheared by said downward force of said pull tab to deflect said primary tear panel about said first hinge.

17. The metallic container end closure of claim 15, wherein said primary score extends from a starting point to a termination point, and said secondary score extends from a starting point to a termination point, wherein a transition zone extends from said termination point of said primary score to said starting point of said secondary score, and said transition zone is configured to be sheared by said downward force generated by said secondary tool.

18. The metallic container end closure of claim 17, wherein said transition zone is an uninterrupted portion of said central panel.

19. The metallic container end closure of claim 17, wherein said starting point of said primary score is positioned in said area of engagement, and said termination point of said primary score is positioned outside of said area of engagement.

20. The metallic container end closure of claim 15, further comprising one of a protrusion and a depression positioned on said secondary tear panel, said one of said protrusion and said depression is configured to receive said secondary tool to provide said downward force on said secondary tear panel.

* * * * *